US007722688B2

(12) United States Patent
Filippini et al.

(10) Patent No.: US 7,722,688 B2
(45) Date of Patent: May 25, 2010

(54) FUEL COMPOSITION HAVING A NORMALLY LIQUID HYDROCARBON FUEL, WATER, A HIGH MOLECULAR WEIGHT EMULSIFIER, AND A NITROGEN-FREE SURFACTANT INCLUDING A HYDROCARBYL SUBSTITUTED CARBOXYLIC ACID OR A REACTION PRODUCT OF THE HYDROCARBYL SUBSTITUTED CARBOXYLIC ACID OR REACTIVE EQUIVALENT OF SUCH ACID WITH AN ALCOHOL

(75) Inventors: Brian B. Filippini, Mentor-on-the-Lake, OH (US); Stuart L. Bartley, Wickliffe, OH (US); David M. Hobson, Derbyshire (GB)

(73) Assignee: The Lubrizol Corporation, Wickliffe, OH (US)

( * ) Notice: Subject to any disclaimer, the term of this patent is extended or adjusted under 35 U.S.C. 154(b) by 1150 days.

(21) Appl. No.: 11/333,668

(22) Filed: Jan. 17, 2006

(65) Prior Publication Data

US 2006/0162240 A1 Jul. 27, 2006

Related U.S. Application Data

(63) Continuation of application No. 10/319,125, filed on Dec. 13, 2002, now abandoned.

(51) Int. Cl.
*C10L 1/18* (2006.01)
*C10L 1/32* (2006.01)

(52) U.S. Cl. ..... 44/301; 44/302; 44/385; 44/388; 44/389; 44/403

(58) Field of Classification Search ..... 44/301, 44/302, 385, 388, 389, 403
See application file for complete search history.

(56) References Cited

U.S. PATENT DOCUMENTS

| | | | | |
|---|---|---|---|---|
| 2,052,026 | A | 8/1936 | Harris | 252/6 |
| 2,548,347 | A | 4/1951 | Caron et al. | 44/70 |
| 3,255,108 | A | 6/1966 | Wiese | 252/32.7 |
| 3,934,969 | A | 1/1976 | Noda et al. | 431/9 |
| 3,958,915 | A | 5/1976 | Noda et al. | 431/9 |
| 4,063,871 | A | 12/1977 | Durin | 431/89 |
| 4,182,614 | A | 1/1980 | Moriyama et al. | 44/51 |
| 4,199,326 | A | 4/1980 | Fung | 44/51 |
| 4,244,702 | A | 1/1981 | Alliger | 44/51 |
| 4,378,230 | A | 3/1983 | Rhee | 44/51 |
| 4,394,131 | A | 7/1983 | Marro, Jr. et al. | 44/51 |
| 4,776,966 | A | 10/1988 | Baker | 252/8.515 |
| 4,891,050 | A | 1/1990 | Bowers et al. | 44/67 |
| 4,892,562 | A | 1/1990 | Bowers et al. | 44/67 |
| 5,000,872 | A | 3/1991 | Olah | 252/314 |
| 5,034,020 | A | 7/1991 | Epperly et al. | 44/358 |
| 5,122,353 | A | 6/1992 | Valentine | 423/244 |
| 5,340,369 | A | 8/1994 | Koch et al. | 44/366 |
| 5,344,467 | A | 9/1994 | Huang et al. | 44/358 |
| 5,360,459 | A | 11/1994 | Kolp et al. | 44/358 |
| 5,376,154 | A | 12/1994 | Daly et al. | 44/358 |
| 5,437,693 | A | 8/1995 | Iizuka et al. | 44/302 |
| 5,501,714 | A | 3/1996 | Valentine et al. | 44/358 |
| 5,505,877 | A | 4/1996 | Krivohlavek | 252/314 |
| 5,518,510 | A | 5/1996 | Daly et al. | 44/314 |
| 5,534,039 | A | 7/1996 | Huang et al. | 44/367 |
| 5,562,742 | A | 10/1996 | Kolp et al. | 44/367 |
| 5,593,464 | A | 1/1997 | Cook et al. | 44/362 |
| 5,693,106 | A | 12/1997 | Peter-Hoblyn et al. | 44/301 |
| 5,749,928 | A | 5/1998 | Epperly et al. | 44/358 |
| 5,834,539 | A | 11/1998 | Krivohlavek | 524/60 |
| 5,882,364 | A | 3/1999 | Dilworth | 44/400 |
| 5,885,310 | A | 3/1999 | Minamidate | 44/301 |
| 5,997,751 | A | 12/1999 | Higo et al. | 210/758 |
| 6,012,915 | A | 1/2000 | Mori et al. | 431/4 |
| 6,027,634 | A | 2/2000 | Shirodkar et al. | 208/39 |
| 6,030,424 | A | 2/2000 | Matsumoto | 44/301 |
| 6,056,792 | A | 5/2000 | Barr et al. | 44/403 |
| 6,066,186 | A | 5/2000 | Matsumoto | 44/301 |
| 6,149,880 | A | 11/2000 | Higo et al. | 422/198 |
| 6,187,063 | B1 | 2/2001 | Gunnerman | 44/301 |
| 6,280,485 | B1 | 8/2001 | Daly et al. | 44/301 |
| 6,379,404 | B1 | 4/2002 | Ru | 44/301 |
| 6,997,964 | B1 * | 2/2006 | Marelli | 44/301 |
| 2002/0011022 | A1 | 1/2002 | Nishida et al. | 44/301 |

FOREIGN PATENT DOCUMENTS

| | | |
|---|---|---|
| EP | 0630398 B1 | 5/1997 |
| EP | 1101815 A2 | 5/2001 |
| EP | 1108776 A1 | 6/2001 |

(Continued)

OTHER PUBLICATIONS

Search Report from corresponding PCT International Application No. PCT/US03/40055 completed May 24, 2002.

(Continued)

*Primary Examiner*—Cephia D Toomer
(74) *Attorney, Agent, or Firm*—Christopher D. Hilker; Teresan W. Gilbert

(57) ABSTRACT

The invention provides a water blended fuel composition made by combining (i) a normally liquid hydrocarbon fuel; (ii) water; (iii) a nitrogen-free surfactant; and an acid having a pKa of up to about 6.

23 Claims, No Drawings

FOREIGN PATENT DOCUMENTS

| | | | |
|---|---|---|---|
| EP | 0811805 | B1 | 9/2002 |
| EP | 0760451 | B1 | 10/2002 |
| JP | 01-252697 | | 10/1989 |
| JP | 2001-139964 | | 5/2001 |
| WO | WO 85/04183 | | 9/1985 |
| WO | WO 00/42132 | | 7/2000 |
| WO | WO 01/51593 | | 7/2001 |
| WO | WO 02/059236 | | 8/2002 |
| WO | WO 03/021078 | | 3/2003 |

OTHER PUBLICATIONS

Derwent Abstract Accession No. 2003-173071 (Korea Patent No. 2002080649 A).

Derwent Abstract Accession No. 2003-173070 (Korea Patent No. 2002080648 A).

Derwent Abstract Accession No. 2003-173069 (Korea Patent No. 2002080647 A).

* cited by examiner

FUEL COMPOSITION HAVING A NORMALLY LIQUID HYDROCARBON FUEL, WATER, A HIGH MOLECULAR WEIGHT EMULSIFIER, AND A NITROGEN-FREE SURFACTANT INCLUDING A HYDROCARBYL SUBSTITUTED CARBOXYLIC ACID OR A REACTION PRODUCT OF THE HYDROCARBYL SUBSTITUTED CARBOXYLIC ACID OR REACTIVE EQUIVALENT OF SUCH ACID WITH AN ALCOHOL

This application is a continuation of U.S. Ser. No. 10/319,125 filed Dec. 13, 2002, now abandoned, and claims the benefit of said prior application.

TECHNICAL FIELD

This invention relates to a water blended fuel composition. More particularly, this invention relates to a water blended fuel composition comprising a normally liquid hydrocarbon fuel, water, and a nitrogen-free surfactant. These fuel compositions may be used in open-flame burners and internal combustion engines.

BACKGROUND OF THE INVENTION

A major objective of using a water blended fuel is to lower NOx (nitrogen oxides) emissions. In internal combustion engines, such as typical diesel engines for on-road vehicles, combustion temperatures usually approach about 2000° C. Under these conditions, the majority of the NOx produced is from oxidized atmospheric nitrogen that is pulled into the engine's manifold. On the other hand, combustion occurs at lower temperatures in open-flame burners such as in industrial boilers. At such lower temperatures, lower amounts of atmospheric $N_2$ are oxidized and most of the NOx produced by such burners results from nitrogen introduced via the fuel and fuel additives.

Current commercial water blended fuel additive formulations, which are formulated for use in internal combustion engines contain on the order of 1000-1500 ppm nitrogen. The base fuel typically introduces about 100 to about 300 ppm nitrogen with the remainder coming from the additives. A significant portion of the nitrogen contributed to these fuels comes from surfactants which are used to stabilize the water blended fuels.

The problem, therefore, is to provide nitrogen-free surfactants for use in applications where nitrogen level is an issue, such as industrial boilers. Low nitrogen content may also become a factor in internal combustion engines as NOx emission levels are expected to be significantly lower by 2007.

This invention provides a solution to this problem by providing a water blended fuel composition containing a nitrogen-free surfactant. These fuels may be used advantageously in open-flame burners such as industrial boilers. These fuels are also useful in internal combustion engines.

SUMMARY OF THE INVENTION

This invention relates to a water blended fuel composition made by combining:

(i) a normally liquid hydrocarbon fuel;

(ii) water; and (iii) a nitrogen-free surfactant comprising:

(iii)(a) a hydrocarbyl substituted carboxylic acid, or a reaction product of the hydrocarbyl substituted carboxylic acid or a reactive equivalent of such acid with an alcohol, the hydrocarbyl substituent of the acid or reactive equivalent thereof containing at least about 30 carbon atoms; and (iii)(b) at least one compound represented by one or more of the formulae:

(iii-b-1)

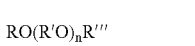

(iii-b-2)

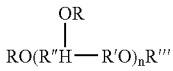

(iii-b-3)

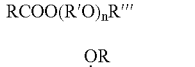

(iii-b-4)

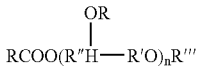

(iii-b-5)

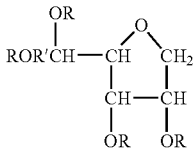

(iii-b-6)

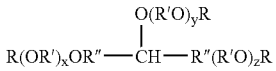

wherein each R is independently hydrogen or a hydrocarbyl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1.

In one embodiment, the water blended fuel composition further comprises an optional acid component, the acid having a pKa of up to about 6.

In one embodiment, the water blended fuel composition is suitable for use as a fuel for an open flame burning apparatus, and in one embodiment as a fuel for an internal combustion engine.

DETAILED DESCRIPTION OF THE INVENTION

The term "hydrocarbyl" and "hydrocarbon," when referring to groups attached to the remainder of a molecule, refer to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, alkoxy, acyl, etc.

(3) Hetero groups; that is, groups which, while predominantly hydrocarbon in character, contain atoms other than carbon in a chain or ring otherwise composed of carbon atoms. Examples include oxygen and sulfur.

In general, no more than about three substituents or hetero atoms, and in one embodiment no more than one, will be present for each 10 carbon atoms in the hydrocarbyl or hydrocarbon group.

The term "lower" as used herein in conjunction with terms such as hydrocarbon, alkyl, alkenyl, alkoxy, and the like, is intended to describe such groups which contain a total of up to 7 carbon atoms.

The term "oil-soluble" refers to a material that is soluble in mineral oil or hydrocarbon fuel to the extent of at least about 0.5 gram per liter at 25° C.

The term "water-soluble" refers to materials that are soluble in water to the extent of at least 0.5 gram per 100 milliliters of water at 25° C.

The Water Blended Fuel Composition

The water blended fuel composition may be in the form of a water-in-oil emulsion or a micro-emulsion. Throughout the specification and in the appended claims the term "oil" (as in water-in-oil emulsion) is sometimes used to refer to the normally liquid hydrocarbon fuel phase of the water blended fuel composition.

The water blended fuel composition contains (i) a normally liquid hydrocarbon fuel, (ii) water, and (iii) a nitrogen-free surfactant. These fuels may also include as optional ingredients one or more acids having a pKa of up to about 6, cetane improvers, non-metallic combustion modifiers, metallic combustion modifiers, water-soluble salts, antifreeze agents, organic solvents, as well as other fuel additives known in the art.

Although the surfactant (iii) used in the inventive water blended fuel composition is a nitrogen-free surfactant and with these fuel compositions it is desirable to reduce or eliminate the use of nitrogen-containing ingredients, it is permissible to include nitrogen containing ingredients (e.g., various cetane improvers, non-metallic combustion modifiers, water-soluble salts such as ammonium nitrate, and the like) in various embodiments of the inventive fuel compositions to provide desirable performance attributes to such fuel compositions.

The water blended fuel composition may be characterized by a continuous oil or fuel phase and a discontinuous or dispersed aqueous phase. These emulsions may be characterized as water-in-oil emulsions or micro emulsions. The term "micro emulsion" generally refers to emulsions wherein the dispersed phase is characterized by droplets having a mean diameter of up to about 0.1 micron. The dispersed aqueous phase for the inventive water blended fuel composition may be comprised of aqueous droplets having a mean diameter of about up to about 50 microns, and in one embodiment about 0.01 to about 50 microns, and in one embodiment about 0.01 to about 30 microns, and in one embodiment about 0.01 to about 20 microns, and in one embodiment about 0.01 to about 10 microns, and in one embodiment, 0.01 to about 5 microns, and in one embodiment about 0.05 to about 2 microns, and in one embodiment about 0.05 to about 1 micron, and in one embodiment about 0.05 to about 0.8 micron, and in one embodiment about 0.1 to about 1.0 micron, and in one embodiment about 0.5 to about 1.0 micron.

The Normally Liquid Hydrocarbon Fuel (i)

The normally liquid hydrocarbon fuel may be a hydrocarbonaceous petroleum distillate fuel such as motor gasoline as defined by ASTM Specification D439 or diesel fuel or fuel oil as defined by ASTM Specification D396. The normally liquid hydrocarbon fuel may be a biodegradable fuel, a biodiesel fuel, or a mixture thereof. The fuel may be a residual fuel. Normally liquid hydrocarbon fuels comprising non-hydrocarbonaceous materials such as alcohols, ethers, and the like (e.g., methanol, ethanol, diethyl ether, methyl ethyl ether) are also within the scope of this invention as are liquid fuels derived from vegetable or mineral sources such as corn, alfalfa, rapeseed, soybeans, shale and coal. The fuel may be derived from Fischer-Tropsch synthesized hydrocarbons. Normally liquid hydrocarbon fuels which are mixtures of one or more hydrocarbonaceous fuels and one or more non-hydrocarbonaceous materials are also contemplated. Examples of such mixtures are combinations of gasoline and ethanol, and diesel fuel and ether.

The gasoline that is useful may be a mixture of hydrocarbons having an ASTM distillation range from about 60° C. at the 10% distillation point to about 205° C. at the 90% distillation point.

The diesel fuel may be any diesel fuel. The diesel fuel may have a 90% point distillation temperature in the range of about 300° C. to about 390° C., and in one embodiment about 330° C. to about 350° C. The viscosity for the diesel fuel may range from about 1 to about 24 centistokes at 40° C. The diesel fuel may be classified as any of Grade Nos. 1-D, 2-D or 4-D as specified in ASTM D975. These diesel fuels may contain alcohols and esters. In one embodiment the diesel fuel has a sulfur content of up to about 0.05% by weight (low-sulfur diesel fuel) as determined by the test method specified in ASTM D2622-87.

The fuel oil may be a Grade No. 1, No. 1 low sulfur, No. 2, No. 2 low sulfur, No. 4, No. 4 light, No. 5 light, No. 5 heavy, or No. 6 as defined by ASTM Specification D396-01. The fuel oil may be a Grade No. 3 fuel oil. The fuel oil may be a residual fuel that is heavier than No. 6. The fuel may comprise bitumen.

The normally liquid hydrocarbon fuel may be present in the water blended fuel composition at a concentration of about 50% to about 99.5% by weight, and in one embodiment about 55 to about 99% by weight, and in one embodiment about 60 to about 98% by weight, and in one embodiment about 65 to about 95% by weight, and in one embodiment about 75 to about 95% by weight.

The Water (ii)

The water may be taken from any convenient source. In one embodiment, the water is deionized. In one embodiment, the water is not deionized. In one embodiment, the water is purified using reverse osmosis or distillation. The water may be in the form of waste water such as condensed steam from a boiler.

The water may be present in the water blended fuel composition at a concentration of about 0.5 to about 50% by weight, and in one embodiment about 1 to about 45% by weight, and in one embodiment about 2 to about 40% by weight, and in one embodiment about 5 to about 35% by weight, and in one embodiment about 5 to about 25% by weight.

The Nitrogen-Free Surfactant (iii)

The nitrogen-free surfactant (iii) may function as an emulsifier and may be referred to as an emulsifier. The surfactant (iii) comprises the combination of surfactant components (iii)(a) and (iii)(b) referred to above and discussed below.

The above-indicated combination of surfactant components provides for the formation of stable emulsions. These emulsions may be characterized by a shelf life of at least about 1 day, and in one embodiment at least about 5 days, and in one embodiment at least about 10 days, and in one embodiment at least about 20 days, and in one embodiment at least about 50 days, and in one embodiment at least about 90 days. While not wishing to be bound by theory it is believed that surfactant component (iii)(a) provides the water blended fuel composition with long-term stability while surfactant component (iii)(b) enables formation of the emulsion rapidly with a small particle size for the aqueous droplets.

The term "nitrogen-free" does not exclude the possibility of nitrogen being present in the surfactant (iii) at contaminate levels. Typical contaminate levels may be up to about 100 ppm, and in one embodiment up to about 200 ppm, and in one embodiment up to about 300 ppm, and in one embodiment up to about 400 ppm, and in one embodiment up to about 500 ppm, and in one embodiment up to about 700 ppm, and in one embodiment up to about 1000 ppm.

The concentration of the surfactant (iii)(a) in the water blended fuel composition may range from about 0.05 to about 5% by weight, and in one embodiment about 0.1 to about 3% by weight, and in one embodiment about 0.1 to about 2% by weight.

The concentration of surfactant (iii)(b) in the water blended fuel composition may range from about 0.05 to about 5% by weight, and in one embodiment about 0.1 to about 3 percent by weight, and in one embodiment about 0.1 to about 2% by weight.

The weight ratio of surfactant (iii)(a) to surfactant (iii)(b) may range from about 1:9 to about 9:1, and in one embodiment about 3:1 to about 1:3, and in one embodiment about 2:1 to about 1:2.5, and in one embodiment about 1:1.5 to about 1:2.5, and in one embodiment about 1:2.

Surfactant Component (iii)(a)

The surfactant component (iii)(a) may be a hydrocarbyl substituted carboxylic acid, or a reaction product of the hydrocarbyl substituted carboxylic acid or a reactive equivalent thereof with an alcohol. The carboxylic acids may be monobasic or polybasic. The polybasic acids include dicarboxylic acids, although tricarboxylic and tetracarboxylic acids may be used. The reactive equivalents may be acid halides, (e.g., chlorides), anhydrides or esters, including partial esters, and the like.

The hydrocarbyl substituted carboxylic acid or reactive equivalent may be made by reacting one or more alpha, beta olefinically unsaturated carboxylic acid reagents containing 2 to about 20 carbon atoms, exclusive of the carboxyl groups, with one or more olefin polymers. The olefin polymers may contain about 30 to about 500 carbon atoms, and in one embodiment about 50 to about 500 carbon atoms.

The alpha-beta olefinically unsaturated carboxylic acid reagents may be either monobasic or polybasic in nature. Exemplary of the monobasic alpha-beta olefinically unsaturated carboxylic acid reagents include the carboxylic acids corresponding to the formula

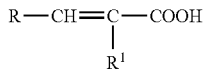

wherein R is hydrogen, or a saturated aliphatic or alicyclic, aryl, alkylaryl or heterocyclic group, and $R^1$ is hydrogen or a lower alkyl group. R may be a lower alkyl group. The total number of carbon atoms in R and $R^1$ typically does not exceed about 18 carbon atoms. Examples include acrylic acid; methacrylic acid; cinnamic acid; crotonic acid; 3-phenyl propenoic acid; alpha, and beta-decenoic acid. The polybasic acid reagents may be dicarboxylic, although tri- and tetracarboxylic acids can be used. Examples include maleic acid, fumaric acid, mesaconic acid, itaconic acid and citraconic acid. Reactive equivalents include the anhydride, halide or ester functional derivatives of the foregoing acids. A useful reactive equivalent is maleic anhydride.

The olefin monomers from which the olefin polymers may be derived are polymerizable olefin monomers characterized by having one or more ethylenic unsaturated groups. They can be monoolefinic monomers such as ethylene, propylene, butene-1, isobutene and octene-1, or polyolefinic monomers (usually di-olefinic monomers such as butadiene-1,3 and isoprene). Usually these monomers are terminal olefins, that is, olefins characterized by the presence of the group $>C{=}CH_2$. However, certain internal olefins can also serve as monomers (these are sometimes referred to as medial olefins). When such medial olefin monomers are used, they normally are employed in combination with terminal olefins to produce olefin polymers that are interpolymers. The olefin polymers may include aromatic groups and alicyclic groups. These include polymers derived from both 1,3-dienes and styrenes, such as butadiene-1,3 and styrene or para-(tertiary butyl) styrene; also included are partially hydrogenated polymers derived from the foregoing.

Generally the olefin polymers are homo- or interpolymers of terminal hydrocarbon olefins of about 2 to about 30 carbon atoms, and in one embodiment about 2 to about 16 carbon atoms, and in one embodiment about 2 to about 6 carbon atoms, and in one embodiment 2 to about 4 carbon atoms.

The olefin polymer may be a polyisobutylene, polypropylene, polyethylene, a copolymer derived from isobutene and butadiene, or a copolymer derived from isobutene and isoprene.

In one embodiment, the olefin polymers are polyisobutenes (or polyisobutylenes) such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes generally contain predominantly (that is, greater than about 50 percent of the total repeat units) isobutene repeat units.

The olefin polymer may be a polyisobutylene having a high methylvinylidene isomer content. These include the polyisobutenes wherein at least about 50% by weight, and in one embodiment at least about 70% by weight, of the polyisobutenes have methylvinylidene end groups. Suitable polyisobutenes having such high methylvinylidene isomer contents include those prepared using boron trifluoride catalysts.

The hydrocarbyl substituted carboxylic acid or reactive equivalent may be a hydrocarbyl (e.g., polyisobutylene) substituted succinic acid or anhydride wherein the hydrocarbyl substituent has from about 30 to about 500 carbon atoms, and in one embodiment from about 50 to about 500 carbon atoms. The hydrocarbyl substituent may have a number average molecular weight of about 750 to about 3000, and in one embodiment about 900 to about 2000. In one embodiment, the number average molecular weight is from about 750 to about 1500, and in one embodiment it is from about 1500 to about 3000.

In one embodiment, the hydrocarbyl-substituted succinic acids or reactive equivalents thereof are characterized by the presence within their structure of an average of at least about 1.3 succinic groups, and in one embodiment from about 1.5 to about 2.5, and in one embodiment form about 1.7 to about 2.1 succinic groups for each equivalent weight of the hydrocarbyl substituent. The ratio of succinic groups to equivalent of substituent groups present in the hydrocarbyl substituted succinic acid or reactive equivalent (also called the "succination ratio") may be determined by one skilled in the art using conventional techniques (e.g., saponification or acid numbers). This is described in U.S. Pat. No. 4,234,435, which is incorporated herein by reference.

The conditions for reacting the alpha, beta olefinically unsaturated carboxylic acid reagent with the olefin polymer are known to those in the art. Examples of patents describing various procedures for preparing useful hydrocarbyl substituted carboxylic acids or reactive equivalents thereof include U.S. Pat. Nos. 3,215,707; 3,219,666; 3,231,587; 3,912,764; 4,110,349; and 4,234,435; and U.K. Patent 1,440,219. The disclosures of these patents are hereby incorporated by reference.

The alcohol which may be reacted with the hydrocarbyl substituted carboxylic acid or reactive equivalent to form surfactant component (iii)(a) may be a mono- or a polyhydric hydrocarbon-based alcohol such as methanol, ethanol, the propanols, butanols, pentanols, hexanols, heptanols, octanols, decanols, and the like. Also included are fatty alcohols and mixtures thereof, including saturated alcohols such as lauryl, myristyl, cetyl, stearyl and behenyl alcohols, and unsaturated alcohols such as palmitoleyl, oleyl and eicosenyl. Higher synthetic monohydric alcohols of the type formed by the Oxo process (e.g., 2-ethylhexanol), by the aldol condensation, or by organoaluminum-catalyzed oligomerixation of alpha-olefins (e.g., ethylene), followed by oxidation, may be used. Alicyclic analogs of the above-described alcohols may be used; examples include cyclopentanol, cyclohexanol, cyclododecanol, and the like.

The polyhydroxy compounds that may be used include ethylene, propylene, butylene, pentylene, hexylene and heptylene glycols; tri-, tetra-, penta-, hexa- and heptamethylene glycols and hydrocarbon-substituted analogs thereof (e.g., 2-ethyl-1,3-trimethylene glycol, neopentyl glycol, etc.), as well as polyoxyalkylene compounds such as diethylene and higher polyethylene glycols, tripropylene glycol, dibutylene glycol, dipentylene glycol, dihexylene glycol and diheptylene glycol, and their monoethers. A glycol that may be used is 1,2-propane diol.

Phenol, naphthols, substituted phenols (e.g., the cresols), and dihydroxyaromatic compounds (e.g., resorcinol, hydroquinone), as well as a benzyl alcohol and similar di-hydroxy compounds wherein the second hydroxy group is directly bonded to an aromatic carbon (e.g., 3-HO$\Phi$CH$_2$OH wherein $\Phi$ is a divalent benzene ring) may be used. Sugar alcohols of the general formula $HOCH_2(CHOH)_{1-5}CH_2OH$ such as glycerol, sorbitol, mannitol, and the like, and their partially esterified derivatives may be used. Oligomers of such sugar alcohols, including diglycerol, triglycerol, hexaglycerol, and the like, and their partially esterfied derivatives may be used. Methylol polyols such as pentaerythritol and its oligomers (di- and tripentaerythritol, etc.), trimethylolethane, trimethylolpropane, and the like may be used.

The surfactant component (iii)(a) may be in the form of an acid, an ester, or a mixture thereof. The acid may be formed by reacting a hydrocarbyl substituted carboxylic acid reactive equivalent with water to provide the desired acid. For example, hydrocarbyl (e.g., polyisobutylene) substituted succinic anhydride may be reacted with water to form hydrocarbyl substituted succinic acid. The reaction between the hydrocarbyl substituted carboxylic acid or reactive equivalent thereof and the alcohol to form an ester may be carried out under suitable ester forming reaction conditions. Typically, the reaction is carried out at a temperature in the range of from about 50° C. to about 250° C.; optionally in the presence of a normally liquid, substantially inert organic liquid solvent/diluent, until the desired product has formed. In one embodiment, the hydrocarbyl substituted carboxylic acid or reactive equivalent thereof and the alcohol are reacted in amounts sufficient to provide from about 0.3 to about 3 equivalents of the acid or reactive equivalent thereof per equivalent of alcohol. In one embodiment, this ratio is from about 0.5:1 to about 2:1.

The number of equivalents of the hydrocarbyl substituted carboxylic acid or reactive equivalent thereof depends on the total number of carboxylic functions present which are capable of reacting with the alcohol. For example, there would be two equivalents in an anhydride derived from the reaction of one mole of olefin polymer and one mole of maleic anhydride.

The weight of an equivalent of an alcohol is its molecular weight divided by the total number of hydroxyl groups present in the molecule. Thus, the weight of an equivalent of ethylene glycol is one-half its molecular weight.

Surfactant Component (iii)(b)

The surfactant component (iii)(b) may be at least one compound represented by one or more of the formulae:

(iii-b-1)

(iii-b-2)

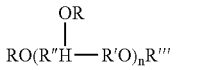

(iii-b-3)

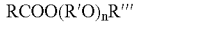

(iii-b-4)

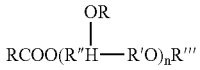

(iii-b-5)

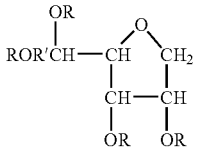

(iii-b-6)

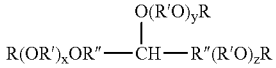

wherein each R is independently hydrogen or a hydrocarbyl group of up to about 60 carbon atoms; each R' and R" is independently an alkylene group of 1 to about 20 carbon atoms; each R"' is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1. In the above formulae, R may be a hydrocarbyl group of about 6 to about 60 carbon atoms, and in one embodiment abut 6 to about 45 carbon atoms, and in one embodiment about 6 to about 30 carbon atoms, and in one embodiment about 14 to about 30 carbon atoms. In one embodiment, R may be a hydrocarbyl group of about 9 to about 11 carbon atoms. R' and R" may be independently alkylene groups of about 1 to about 6 carbon atoms, and in one embodiment about 1 to about 4 carbon atoms. In one embodiment, R' is an alkylene group containing about 2 to about 3 carbon atoms, and in one embodiment about 2 carbon atoms. In one embodiment, R" is an alkylene group containing 1 carbon atom. R"' may be an acyl or hydrocarbyl group of 1 to about 30 carbon atoms, and in one embodiment 1 to about 24 carbon atoms, and in one embodiment 1 to about 18 carbon atoms, and in one embodiment 1 to about 12 carbon atoms, and in one embodiment 1 to about 6 carbon atoms. n may be a number in the range of 1 to about 50, and in one embodiment 1 to about 30, and in one embodiment 1 to about 20, and in one embodiment 1 to about 12, and in one embodiment about 4 to about 10, and in one embodiment about 5 to about 10, and in one embodiment about 5 to about 8, and in one embodiment about 5 or about 6. x, y and z may be independently numbers in the range of zero to about 50, and in one embodiment zero to about 30, and in one embodiment zero to about 10; with the total of x, y and z being at least 1, and in one embodiment in the range of 1 to about 50, and in one embodiment 10 to about 40, and in one embodiment 20 to about 30, and in one embodiment about 25.

Examples of compounds represented by formula (iii-b-1) that may be used include: $C_9$-$C_{11}$ alkoxy poly (ethoxy)$_8$ alcohol; $C_{12}$-$C_{15}$ alkoxy poly (isopropoxy)$_{22-26}$ alcohol; oleyl alcohol pentaethoxylate; and the like.

Examples of compounds represented by formula (iii-b-2) that may be used include diglycerol monooleate, diglycerol monosteaate, polyglycerol monooleate, and the like.

Examples of compounds represented by formula (iii-b-3) that may be used include polyethylene glycol (Mn=200) distearate, polyethylene glycol (Mn=400) distearate, polyethylene glycol (Mn=200) dioleate, polyethylene glycol (Mn=400) soya bean oil ester, and the like.

Examples of compounds represented by formula (iii-b-4) that may be used include glycerol monooleate, diglycerol dioleate, diglycerol distearate, polyglycerol dioleate, and the like.

Examples of compounds represented by formula (iii-b-5) that may be used include sorbitan monooleate, sorbitan monoisostearate, sorbitan sesquioleate, and sorbitan trioleate, and the like.

Examples of compounds represented by formula (iii-b-6) that may be used include polyethoxy glycerol trioleate wherein the compound contains 25 ethoxy groups.

In one embodiment, the surfactant (iii)(b) is an alkoxy polyethoxy alcohol wherein the alkoxy group contains about 14 to about 30 carbon atoms and the polyethoxy group contains up to about 10 ethoxy groups, and in one embodiment about 5 to about 10 ethoxy groups, and in one embodiment about 5 or 6 ethoxy groups.

In one embodiment, the surfactant (iii)(b) is an alkoxy polyethoxy alcohol wherein the alkoxy group contains about 9 to about 11 carbon atoms and the polyethoxy group contains about 8 ethoxy groups.

Optional Acid Component

An optional acid component that may be used in the inventive fuel composition comprises one or more acids having a pKa of up to about 6, and in one embodiment up to about 5, and in one embodiment up to about 4, and in one embodiment from about 0 to about 4, and in one embodiment about 1 to about 3.5, and in one embodiment about 1.5 to about 3. This acid component may be a carboxylic acid. Examples of the carboxylic acids that may be used include those represented by the formula $$(X)_m R(COOH)_n \qquad \text{(OAC-1)}$$

wherein in formula (OAC-1), X is an electron withdrawing group, R is hydrogen or a hydrocarbon group, m is a number in the range of zero to about 10, and n is a number that is at least 1. Examples of the electron withdrawing groups X that may be used include hydroxyl groups, alkoxy groups, acyl groups, carboalkoxy groups, keto groups, oxo group, aromatic rings, or a combination of two or more thereof. R may be an aliphatic, alicyclic, aromatic, aliphatic- or alicyclic-substituted aromatic, aromatic-substituted aliphatic or alicyclic group. R may contain 1 to about 18 carbon atoms, and in one embodiment 1 to about 10 carbon atoms, and in one embodiment 1 to about 6 carbon atoms. m may be a number in the range of 1 to about 10, and in one embodiment 1 to about 6, and in one embodiment 1 to about 4. n may be a number in the range of 1 to about 10, and in one embodiment 1 to about 8, and in one embodiment 1 to about 4, and in one embodiment 1 to about 2. When n is 2 or more, the additional COOH groups may serve as electron withdrawing groups. Examples of the acids that may be used include:

| Acid | pKa |
|---|---|
| Formic acid | 3.75 |
| Acetylenedicarboxylic acid | 1.75 |
| Benzenehexacarboxylic acid | 0.68 |
| Benzenepentacarboxylic acid | 1.80 |
| Benzenetetracarboxylic acid | 1.92 |
| Benzenetricarboxylic acid | 2.12 |
| 2-Butyn-1,4-dioic acid | 1.75 |
| 2-Butynoic acid | 2.62 |
| Citraconic acid | 2.29 |
| Cyclopropane-1,1-dicarboxylic acid | 1.82 |
| 2,6-Dihydroxybenzoic acid | 1.30 |
| Dihydroxymaleic acid | 1.10 |
| Dihydroxymalic acid | 1.92 |
| Dihydroxytatric acid | 1.95 |
| alpha, alpha-Dimethyloxaloacetic acid | 1.77 |
| Dipropylmalonic acid | 2.04 |
| Ethylene oxide dicarboxylic acid | 1.93 |
| Hydroxyaspartic acid | 1.91 |
| Maleic acid | 1.91 |
| 2-Oxobutanoic acid | 2.50 |
| Triethylsuccinic acid | 2.74 |
| Citric acid | 3.13 |
| Tartaric Acid | 2.98 |
| Glyoxylic acid | 3.34 |
| Oxalic acid | 1.23 |
| Lactic acid | 3.08 |
| Oxomalonic acid (mesoxalic acid) | |

When used, this acid component may function as an ionizing agent. The concentration of this acid component in the water blended fuel composition may range up to about 5 percent by weight, and in one embodiment from about 0.001 to about 3 percent by weight, and in one embodiment about 0.01 to about 1 percent by weight.

Cetane Improvers

The cetane improvers include peroxides, percarbonates, nitro compounds, nitrates, nitrites, nitrocarbamates, and the like. Examples include nitropropane, 2-nitro-2-methyl-1-butanol, and the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms. The alkyl group may be either linear or branched. Examples include methyl nitrate, butyl nitrate, 2-ethylhexyl nitrate, and the like.

The concentration of the cetane improver in the water blended fuel composition may be at a level of up to about 10% by weight, and in one embodiment about 0.05 to about 5% by weight.

Non-Metallic Combustion Modifiers

The non-metallic combustion modifiers include strained ring compounds, nitro compounds, nitrates, and certain hydroxyamines. Strained ring compounds are compounds containing cyclic rings of about 3 to about 5 atoms, and in one embodiment about 3 to about 4 atoms. The strained rings are typically saturated, but the about 3 and about 4 membered rings may contain olefinic unsaturation. The strained ring compounds may be monocyclic or polycyclic compounds. The polycyclic compounds may have fused ring systems, and/or ring systems connected directly or via a bridge group, and/or spiro-compounds. The polycyclic compounds may have, for example, from about 2 to about 4 rings. The rings may contain one or more heteroatoms (e.g., O, S or N). Typically the heterocyclic rings contain at least about 2 carbon atoms and no more than about 2 heteroatoms, and generally only 1 heteroatom. Examples of useful strained ring compounds or groups include dioxolane, epoxide, oxetane and furan. Specific examples include cyclopropyl methanol, cyclobutyl amine, cyclobutyl hydroxyamine, 3,3-dimethyloxetane, 1-methoxy-2-methylpropylene oxide, 2-methoxydioxolane and 2,5-dimethoxytetrahydrofuran.

The nitro compounds may be aliphatic or aromatic. They may contain one or more than one nitro group. The nitro compounds include purely hydrocarbon and substituted hydrocarbon compounds. Examples include nitromethane, nitropropane, dinitropropane, hydroxymethyl nitropropane, 1,3-dimorpholino-2-nitropropane, 1,2-dinitropropane, 2-methyl-2-nitropropane, bis(2-nitropropyl)methane, tetranitromethane, nitrobenzene, dinitrotoluene, trinitrotoluene, and nitrated phenols (e.g., butyl-dinitrophenol).

The hydroxyamines useful as combustion improvers may be represented by the formulae

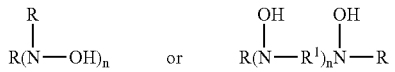

wherein each R is independently hydrogen or a hydrocarbyl group, $R^1$ is an alkylene group, and n is a number ranging from 1 to about 30. These types of hydroxyamines wherein the hydroxyl group is attached directly to the nitrogen are also known as hydroxylamines. Each R may be a primary or secondary hydrocarbyl group. Each R group may contain from 1 to about 25 carbon atoms, and in one embodiment 1 to about 8 carbon atoms. $R^1$ may be a lower alkylene group, and in one embodiment it is ethylene or a propylene group. n may range from 1 to about 10, and in one embodiment 1 to about 5. Salts of these hydroxyamines may also be used. The salts include nitrates, sulfates, sulfonates, carbonates and carboxylates. Examples of these hydroxyamines are disclosed in U.S. Pat. Nos. 3,491,151; 4,017,512; 5,731,462; 5,733,935; and 6,031,130, which are incorporated herein by reference.

The concentration of the non-metallic combustion modifier in the water blended fuel composition may range up to about 5% by weight, and in one embodiment about 0.005 to about 2% by weight.

Metallic Combustion Modifiers

The metallic combustion modifiers include fuel soluble metallic compounds that enhance the burning characteristics of the fuel. The metal may be Fe, Pt, Sr, Ce, Cu, Pd, Al, Ru or a combination of two or more thereof. The fuel soluble compound may be in the form of a organometallic complex or a coordination compound. Examples of such complexes or coordination compounds include those disclosed in U.S. Pat. Nos. 4,891,050; 4,892,562; 5,034,020; 5,340,369; 5,344,467; 5,360,459; 5,376,154; 5,501,714; 5,518,510; 5,534,039; 5,562,742; 5,593,464; 5,693,106; 5,749,928; and 6,056,792. These patents are incorporated herein by reference.

These complexes or coordination compounds may be added to the water blended fuel composition at level sufficient to provide a concentration of the metal in the range of up to about 200 parts per million by weight (ppmw), and in one embodiment about 0.1 to about 200 ppmw, and in one embodiment about 0.2 to 100 ppmw, and in one embodiment about 0.5 to about 50 ppmw.

Water-Soluble Salt

The water blended fuel composition may contain one or more water-soluble salts. These may be any material capable of forming positive and negative ions in an aqueous solution that does not interfere with the other additives or the hydrocarbon fuel. These include organic amine nitrates, azides, and nitro compounds. Also included are alkali and alkaline earth metal carbonates, sulfates, sulfides, sulfonates, and the like. Included are the amine or ammonium salts represented by the formula $$k[G(NR_3)_y]^{y+}nX^{p-}$$

wherein G is hydrogen or an organic group of 1 to about 8 carbon atoms, and in one embodiment 1 to about 2 carbon atoms, having a valence of y; each R independently is hydrogen or a hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, urea nitrate, urea dinitrate, and mixtures of two or more thereof.

In one embodiment, the water-soluble salt functions as an emulsion stabilizer, i.e., it acts to stabilize the aqueous hydrocarbon fuel compositions.

In one embodiment, the water-soluble salt functions as a combustion improver. A combustion improver is characterized by its ability to increase the mass burning rate of the fuel composition. Thus, the presence of such combustion improvers has the effect of improving the power output of an engine.

The water-soluble salt may be present in the water blended fuel composition at a concentration of up to about 1% by weight, and in one embodiment about 0.001 to about 1% by weight, and in one embodiment from about 0.01 to about 1% by weight.

Antifreeze Agent

In one embodiment, the water blended fuel composition contains an antifreeze agent. The antifreeze agent may be an alcohol or an ether. Examples include ethylene glycol, propylene glycol, methanol, ethanol, and mixtures thereof. The antifreeze agent is typically used at a concentration sufficient to prevent freezing of the water used in the water blended fuel composition. In one embodiment, the concentration is at a level of up to about 10% by weight, and in one embodiment about 1 to about 5% by weight.

Other Fuel Additives

In addition to the foregoing, other fuel additives which are well known to those of skill in the art may be used. These include antiknock agents, lead scavengers, ashless dispersants, deposit preventers or modifiers, dyes, antioxidants, rust inhibitors, corrosion inhibitors, bacteriostatic agents, gum inhibitors, metal deactivators, upper cylinder lubricants, biocides, and the like. These fuel additives may be used at concentrations that typically range up to about 1% by weight for each additive based on the total weight of the water blended fuel composition, and in one embodiment about 0.01 to about 1% by weight.

Organic Solvent

The surfactant (iii), as well as other oil-soluble fuel additives (e.g., cetane improvers, dispersants, deposit preventers or modifiers, etc.), may be diluted with a substantially inert, normally liquid organic solvent such as mineral oil, kerosene, diesel fuel, synthetic oil (e.g., ester of dicarboxylic acid), naphtha, alkylated (e.g., $C_{10}$-$C_{13}$ alkyl) benzene, toluene or xylene to form an additive concentrate which is then mixed with the normally liquid hydrocarbon fuel and water. These concentrates generally contain from about 10% to about 90% by weight of the foregoing solvent. The water blended fuel composition may contain up to about 10% by weight organic solvent, and in one embodiment about 0.01 to about 5% by weight.

Process for Forming the Water Blended Fuel Composition

The normally liquid hydrocarbon fuel, water, surfactant, and optionally other ingredients as discussed above may be mixed under appropriate mixing conditions to form the desired water blended fuel composition. The mixing may involve high shear mixing, low shear mixing, or a combination thereof. The mixing may be conducted using a single mixing step or multiple mixing steps. The mixing may be conducted on a batch basis, a continuous basis, or a combination thereof. The shear rate for the mixing may be up to about 500,000 $sec^{-1}$, and in one embodiment about 20,000 to about 200,000 $sec^{1}$, and in one embodiment about 25,000 to about 120,000 $sec^{-1}$. The mixing may be conducted at a temperature in the range of about 0° C. to about 100° C., and in one embodiment about 10° C. to about 50° C.

The Open-Flame Burning Apparatus

The open-flame burning apparatus may be any open-flame burning apparatus equipped to burn a liquid fuel. These include domestic, commercial and industrial burners. The industrial burners include those requiring preheating for proper handling and atomization of the fuel. Also included are oil fired combustion units, oil fired power plants, fired heaters and boilers, and boilers for use in ships including deep draft vessels. The fuel burning apparatus may be a boiler for commercial applications such as schools, hospitals, apartment buildings and other large buildings. Included are boilers for power plants, utility plants, and large stationary and marine engines. The open-flame fuel burning apparatus may be an incinerator such as rotary kiln incinerator, liquid injection kiln, fluidized bed kiln, cement kiln, and the like. Also included are steel and aluminum forging furnaces. The open-flame burning apparatus may be equipped with a flue gas recirculation system.

The Internal Combustion Engine

The internal combustion engine may be any internal combustion engine. These engines include spark-ignited (or gasoline) and compression-ignited (or diesel) internal combustion engines, including automobile and truck engines, two-cycle engines, aviation piston engines, marine and railroad diesel engines, and the like. Included are on and off-highway vehicle engines. The engine may be a turbine engine. The engine may be a homogeneous charge compression ignition engine (HCCl). The diesel engines include those for both mobile and stationary power plants. The diesel engines include those used in urban buses, as well as all classes of trucks. The diesel engines may be of the two-stroke per cycle or four-stroke per cycle type. The diesel engines include heavy duty diesel engines.

Example 1

The following water blended fuel formulations are prepared in five gallon quantities using a high shear mixer (all numerical values being in parts by weight):

| | A | B |
|---|---|---|
| No. 2 fuel oil | 87.17 | 77.17 |
| Polyisobutene (Mn = 2300) substituted succinic anhydride hydrolyzed with water (21.5/0.44 anhydride to water weight ratio) to form the corresponding acid, and diluted with oil (44.7 wt % diluent oil) | 1.90 | 1.90 |
| Alkoxy poly ethoxylated alcohol represented by formula $RO(CH_2CH_2O)_8H$ where R is $C_9$–$C_{11}$ | 0.52 | 0.52 |
| Tartaric acid | 0.41 | 0.41 |
| Distilled water | 10.00 | 20.00 |

The water blended fuel compositions for formulations A and B are water-in-oil emulsions characterized by a continuous oil phase, and a discontinuous aqueous phase. The discontinuous aqueous phase is comprised of aqueous droplets having a mean diameter of 0.8 micron for formulation A, and 1.0 micron for formulation B.

The water blended fuel compositions for formulations A and B along with a baseline control sample of the fuel oil used in these formulations have the following properties:

| | Baseline | Formulation A | Formulation B |
|---|---|---|---|
| Percent Nitrogen (ASTM D 4629) | 0.0250 | 0.0219 | 0.0223 |
| Percent Sulfur (ASTM D 2622) | 0.3274 | 0.1683 | 0.1121 |
| Specific gravity (ASTM D 4052) | 0.8567 | 0.8723 | 0.8840 |
| Viscosity @ 40° C., cSt (ASTM D445-40) | 2.27 | 3.41 | 4.60 |
| Flash Point, ° C. (ASTM D93) | 67 | 74 | 74 |
| Weight Percent Water | 0.050 | 7.96 | 18.61 |

The baseline fuel as well as formulations A and B are evaluated in two different boilers using three different burners. The first boiler (Boiler No. 1) is a GO-3 conventional North American design three-section, wet base, cast iron boiler. The second boiler (Boiler No. 2) is a V83 conventional European design three-section, wet base, cast iron boiler. The three burners are a standard burner, a high performance burner and a low emissions burner. The fuel flow in each burner is adjusted to a heating rate of 140,000 BTU/hr. The flue gas has an $O_2$ concentration of 3.0%, and a $CO_2$ concentration of 13.3%. The feed rate for each fuel is as follows:

| | Baseline | Formulation A | Formulation B |
|---|---|---|---|
| Relative feed (gal/hr) | 1.0 | 1.062 | 1.112 |
| Percent flow increase | — | 6.3 | 11.2 |
| Net heating oil consumption (gal/hr.) | 1.0 | 0.96 | 0.89 |

The $NO_x$ emissions for each burner are as follows for Boiler No. 1:

| | Base line | Formulation A | | Formulation B | |
|---|---|---|---|---|---|
| | $NO_x$(ppm) | $NO_x$ (ppm) | % Reduction | $NO_x$ (ppm) | % Reduction |
| Standard Burner | 180 | 149 | 17.2 | 109 | 39.4 |
| High Performance Burner | 121 | 99 | 18.2 | 92 | 24.0 |
| Low Emissions Burner | 72 | 68 | 5.6 | 61 | 15.3 |

The $NO_x$ emissions for each burner are as follows for Boiler No. 2:

| | Base line | Formulation A | | Formulation B | |
|---|---|---|---|---|---|
| | $NO_x$(ppm) | $NO_x$ (ppm) | % Reduction | $NO_x$ (ppm) | % Reduction |
| Standard Burner | 162 | 136 | 16.0 | 106 | 34.6 |
| High Performance Burner | 120 | 108 | 10.0 | 100 | 16.7 |
| Low Emissions Burner | 64 | 60 | 6.3 | 51 | 20.3 |

While the invention has been explained in relation to specific embodiments, it is to be understood that various modifications thereof will become apparent to those skilled in the art upon reading the specification. Therefore, it is to be understood that the invention disclosed herein is intended to cover such modifications as fall within the scope of the appended claims.

The invention claimed is:

1. A water blended fuel composition made by combining:

(i) a normally liquid hydrocarbon fuel;

(ii) water; and (iii) a nitrogen-free surfactant comprising:

(iii)(a) a nitrogen-free surfactant of a hydrocarbyl substituted carboxylic acid, or a reaction product of the hydrocarbyl substituted carboxylic acid or reactive equivalent of such acid with an alcohol, the hydrocarbyl substituent of the acid or reactive equivalent containing at least about 30 carbon atoms; and (iii)(b) a nitrogen-free surfactant of a at least one compound represented by one or more of the formulae:

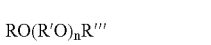
(iii-b-1)

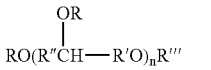
(iii-b-2)

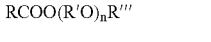
(iii-b-3)

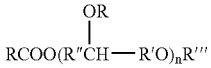
(iii-b-4)

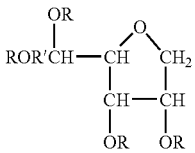
(iii-b-5)

-continued

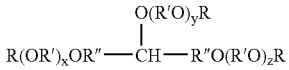
(iii-b-6)

wherein the composition further comprises an acid having a pKa of about 1.5 up to about 6; and wherein each R is independently hydrogen or a hydrocarbyl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1.

2. The composition of claim 1 wherein the normally liquid hydrocarbon fuel comprises a petroleum distillate; an alcohol; an ether; a fuel derived from a vegetable source; a fluid derived from a mineral source; or a mixture of two or more thereof.

3. The composition of claim 1 wherein the composition further comprises a cetane improver, non-metallic combustion modifier, metallic combustion modifier, water-soluble salt, antiknock agent, lead scavenger, ashless dispersant, deposit preventor or modifier, dye, antioxidant, rust inhibitor, corrosion inhibitor, bacteriostatic agent, gum inhibitor, metal deactivator, upper cylinder lubricant, antifreeze agent, biocide, organic solvent, or a mixture of two or more thereof.

4. The composition of claim 1 wherein the hydrocarbyl substituent for the nitrogen-free surfactant of (iii)(a) is derived from polyisobutene, polypropylene, polyethylene, a copolymer derived from isobutene and butadiene, or a copolymer derived from isobutene and isoprene.

5. The composition of claim 1 wherein the nitrogen-free surfactant of (iii)(a) comprises a polyisobutene substituted succinic acid.

6. The composition of claim 1 wherein the nitrogen-free surfactant of (iii)(a) comprises the reaction product of a polyisobutene substituted succinic acid or reactive equivalent thereof with an alcohol.

7. The composition of claim 1 wherein the nitrogen-free surfactant of (iii)(b) is represented by formula (iii-b-1) where R is a hydrocarbyl group of about 6 to about 30 carbon atoms, R' is an alkylene group of about 2 to about 4 carbon atoms, R''' is hydrogen, and n is a number in the range of 1 to about 10.

8. The composition of claim 1 wherein the nitrogen-free surfactant of (iii)(b) is represented by formula (iii-b-1) wherein R is a hydrocarbyl group of about 9 to about 11 carbon atoms, R' is an alkylene group of about 2 carbon atoms, R''' is hydrogen, and n is about 8.

9. The composition of claim 1 wherein the nitrogen-free surfactant of (iii)(b) is represented by the formula (iii-b-1), wherein R is a hydrocarbyl group of about 14 to about 30 carbon atoms, R' is an alkylene group of about 2 carbon atoms, R''' is hydrogen, and n is in the range of about 5 to about 10.

10. The composition of claim 1 wherein the compound represented by formula (iii-b-1) is $C_9$-$C_{11}$ alkoxy poly (ethoxy)$_8$ alcohol; $C_{12}$-$C_{15}$ alkoxy poly (isopropoxy)$_{22-26}$ alcohol; oleyl alcohol pentaethoxylate, or a mixture of two or more thereof.

11. The composition of claim 1 wherein the compound represented by formula (iii-b-2) is diglycerol monooleate, diglycerol monostearate, polyglycerol monooleate, or a mixture of two or more thereof.

12. The composition of claim 1 wherein the compound represented by formula (iii-b-3) is polyethylene glycol distearate, polyethylene glycol dioleate, polyethylene glycol soya bean oil ester, or a mixture of two or more thereof.

13. The composition of claim 1 wherein the compound represented by formula (iii-b-4) is glycerol monooleate, diglycerol dioleate, diglycerol distearate, polyglycerol dioleate, or a mixture of two or more thereof.

14. The composition of claim 1 wherein the compound represented by formula (iii-b-5) is sorbitan monooleate, sorbitan monoisostearate, sorbitan sesquioleate, sorbitan trioleate, or a mixture of two or more thereof.

15. The composition of claim 1 wherein the compound represented by formula (iii-b-6) is polyethoxy glycerol trioleate.

16. The composition of claim 1 wherein component (iii)(b) comprises at least one of the following acids: carboxylic acid, succinic acid, formic acid, acetylenedicarboxylic acid, benzenehexacarboxylic acid, benzenepentacarboxylic acid, benzenetetracarboxylic acid, benzenetricarboxylic acid, 2-butyn-1,4-dioic acid, 2-butynoic acid, citraconic acid, cyclopropane-1,1-dicarboxylic acid, 2,6-dihydroxybenzoic acid, dihydroxymaleic acid, alpha, alpha-dimethyloxaloacetic acid, dipropylmalonic acid, ethylene oxide dicarboxylic acid, maleic acid, 2-oxobutanoic acid, triethylsuccinic acid, citric acid, tartaric acid, glyoxalic acid, oxalic acid, lactic acid and oxomalonic acid.

17. The composition of claim 1 wherein the acid having a pKa of about 1.5 up to about 6 comprises tartaric acid.

18. A combustion process comprising combusting the fuel composition of claim 1 in equipment selected from the group comprising an open flame burner, engine and combination thereof.

19. A water blended fuel composition made by combining:

a normally liquid hydrocarbon fuel;

water;

an acid having a pKa of about 1.5 up to about 6;

a polyisobutene-substituted succinic acid wherein the polyisobutene group has a number average molecular weight in the range of about 750 to about 3000; and an alkoxy polyethoxy alcohol wherein the alkoxy group contains about 9 to about 11 carbon atoms and the polyethoxy group contains about 8 ethoxy groups.

20. A water blended fuel composition made by combining:

a normally liquid hydrocarbon fuel;

water;

an acid having a pKa of about 1.5 up to about 6;

a polyisobutene-substituted succinic acid wherein the polyisobutene group has a number average molecular weight in the range of about 750 to about 3000; and an alkoxy polyethoxy alcohol wherein the alkoxy group contains about 14 to about 30 carbon atoms and the polyethoxy group contains up to about 10 ethoxy groups.

21. A method of making a water blended fuel composition, comprising mixing at a shear rate of up to about 500,000 $sec^{-1}$:

(i) a normally liquid hydrocarbon fuel;

(ii) water; and (iii) a nitrogen-free surfactant comprising:

(iii)(a) a hydrocarbyl substituted carboxylic acid, or a reaction product of the hydrocarbyl substituted carboxylic acid or reactive equivalent of such acid with an alcohol, the hydrocarbyl substituent of the acid or reactive equivalent containing at least about 30 carbon atoms; and (iii)(b) at least one compound represented by one or more of the formulae:

(iii-b-1)

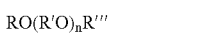

(iii-b-2)

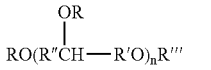

(iii-b-3)

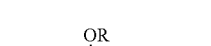

(iii-b-4)

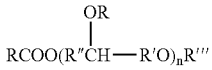

(iii-b-5)

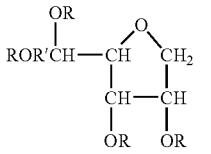

(iii-b-6)

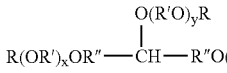

wherein the composition further comprises an acid having a pKa of about 1.5 up to about 6; and wherein each R is independently hydrogen or a hydrocarbyl group of up to about 60 carbon atoms; each R' and R" is independently an alkylene group of 1 to about 20 carbon atoms; each R''' is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1.

22. A water blended fuel composition made by combining:

(i) a normally liquid hydrocarbon fuel;

(ii) water; and (iii) a nitrogen-free surfactant comprising:

(iii)(a) a nitrogen-free surfactant of a hydrocarbyl substituted carboxylic acid, or a reaction product of the hydrocarbyl substituted carboxylic acid or reactive equivalent of such acid with an alcohol, the hydrocarbyl substituent of the acid or reactive equivalent containing at least about 30 carbon atoms; and (iii)(b) a nitrogen-free surfactant of a at least one compound represented by one or more of the formulae:

(iii-b-1)

$$RO(R'O)_nR'''$$

(iii-b-2)

$$RO(R''\underset{\underset{OR}{|}}{CH}-R'O)_nR'''$$

(iii-b-3)

$$RCOO(R'O)_nR'''$$

(iii-b-4)

$$RCOO(R''\underset{\underset{OR}{|}}{CH}-R'O)_nR'''$$

(iii-b-5)

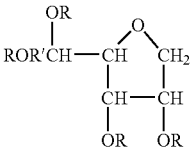

-continued (iii-b-6)

$$R(OR')_xOR''-\underset{\underset{O(R'O)_yR}{|}}{CH}-R''O(R'O)_zR$$

wherein the composition further comprises an acid having a pKa of about 1.5 up to about 3; and wherein each R is independently hydrogen or a hydrocarbyl group of up to about 60 carbon atoms; each R' and R" is independently an alkylene group of 1 to about 20 carbon atoms; each R'" is independently hydrogen, or an acyl or hydrocarbyl group of up to about 30 carbon atoms; n is a number in the range of zero to about 50; and x, y and z are independently numbers in the range of zero to about 50 with the total for x, y and z being at least 1.

23. The composition of claim 1 wherein the normally liquid hydrocarbon fuel comprises diesel fuel, gasoline, fuel oil, an ethanol, a biodegradable fuel, a biodiesel fuel, a residual fuel, bitumen, a liquid fuel derived from corn, alfalfa, rapeseed, soybeans, shale, coal, or a mixture of two or more thereof, a fuel derived from a Fischer-Tropsch synthesized hydrocarbon, or a mixture of two or more thereof.

* * * * *